US012509893B2

(12) United States Patent
Sorkin

(10) Patent No.: US 12,509,893 B2
(45) Date of Patent: Dec. 30, 2025

(54) LIGHTWEIGHT DUAL ACTION POST-TENSIONING JACK WITH TWO HANDLE CHUCK

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

(21) Appl. No.: 18/972,261

(22) Filed: Dec. 6, 2024

(65) Prior Publication Data

US 2025/0188757 A1 Jun. 12, 2025

Related U.S. Application Data

(60) Provisional application No. 63/557,808, filed on Feb. 26, 2024, provisional application No. 63/606,776, filed on Dec. 6, 2023.

(51) Int. Cl.
*E04G 21/12* (2006.01)

(52) U.S. Cl.
CPC ..... *E04G 21/121* (2013.01)

(58) Field of Classification Search
CPC . E04G 21/121; E04G 21/12; E04G 2021/128; E04G 23/0218; Y10T 29/5383; Y10T 29/49874; Y10T 29/53796; F16G 11/12; B28B 23/046; B28B 23/043; E04C 5/12; E04C 5/122; E04C 5/125; E04C 5/163
USPC ..... 254/29 A, 93 R, 29 R, 89 R, 89 H; 52/223.14
See application file for complete search history.

(56) References Cited

U.S. PATENT DOCUMENTS 2,871,554 A * 2/1959 Siegfried ..... E04G 21/121 445/67
3,090,598 A 5/1963 Odilo
3,176,961 A 4/1965 Glass
3,701,509 A * 10/1972 Stinton et al. ..... E04C 5/122 52/223.13
3,703,030 A * 11/1972 Simms ..... E04G 21/121 29/452

(Continued)

FOREIGN PATENT DOCUMENTS

DE 3216741 A1 * 11/1983
EP 0665379 A1 8/1995

(Continued)

OTHER PUBLICATIONS

Stressing Tendons with Short Tendon Tails, from https://www.amsyscoinc.com/2013/06/13/stressing-tendons-with-short-tendon-tails/ ; archived Jul. 27, 2013 (Year: 2013).*

(Continued)

*Primary Examiner* — David S Posigian
*Assistant Examiner* — Steven Huang
(74) *Attorney, Agent, or Firm* — HUNTON ANDREWS KURTH LLP

(57) ABSTRACT

Exemplary embodiments may include a lightweight post-tensioning jack that also maintains a gap in a resting position to avoid potential pinch hazards. The lightweight post-tensioning jack may have dual-handles. It may also include a tendon chuck that is capable of providing enough friction between the chuck and tendon to avoid slippage and tensioning inefficiencies. The chuck assembly may be moved using a slidable handle; that is, one of the dual handles may be fixed and the other may be slidable to move the chuck.

15 Claims, 12 Drawing Sheets

(56) References Cited

U.S. PATENT DOCUMENTS

| | | | | |
|---|---|---|---|---|
| 3,785,617 | A | 1/1974 | Friedrich | |
| 3,811,653 | A | 5/1974 | Persicke | |
| 3,902,698 | A | 9/1975 | Furrer | |
| 3,954,005 | A | 5/1976 | Edwards | |
| 4,106,752 | A | 8/1978 | Roqueta | |
| 4,110,643 | A | 8/1978 | Muller | |
| 4,186,169 | A | 1/1980 | Black | |
| 4,302,978 | A | 12/1981 | Dykmans | |
| 4,302,979 | A | 12/1981 | Dykmans | |
| 4,746,096 | A | 5/1988 | Donnell | |
| 4,805,877 | A * | 2/1989 | Hoekstra | G01L 5/06 15/257.06 |
| 4,862,576 | A | 9/1989 | Lu | |
| 5,342,568 | A | 8/1994 | Yokota | |
| 5,452,629 | A | 9/1995 | Heiermann | |
| 6,070,314 | A | 6/2000 | Pithan | |
| 6,224,036 | B1 * | 5/2001 | Prince | E04G 21/121 29/452 |
| 6,290,473 | B1 | 9/2001 | Thome et al. | |
| 6,318,038 | B1 | 11/2001 | Park | |
| 6,328,541 | B1 | 12/2001 | Veronesi | |
| 6,470,636 | B1 | 10/2002 | Rose | |
| 6,739,129 | B2 | 5/2004 | Heusser | |
| 6,848,323 | B2 | 2/2005 | Krauth | |
| 7,147,210 | B2 | 12/2006 | Foege et al. | |
| 8,152,458 | B2 | 4/2012 | Buell | |
| 8,702,066 | B2 | 4/2014 | Steidinger et al. | |
| 9,103,131 | B2 | 8/2015 | Damage | |
| 9,506,492 | B2 | 11/2016 | Trautman | |
| 10,203,268 | B2 | 2/2019 | Parker | |
| 10,281,270 | B2 | 5/2019 | Smith | |
| 10,364,816 | B2 | 7/2019 | Nofal et al. | |
| 10,400,801 | B2 | 9/2019 | Boehler | |
| 10,830,655 | B2 | 11/2020 | Cook | |
| 10,844,619 | B2 | 11/2020 | Kang | |
| 11,162,482 | B2 | 11/2021 | Dawson et al. | |
| 2005/0177992 | A1 * | 8/2005 | Foege | E04G 21/121 29/508 |
| 2007/0271762 | A1 * | 11/2007 | Hohensee | E04G 21/121 29/452 |
| 2014/0016114 | A1 | 1/2014 | Lopez | |
| 2016/0333902 | A1 | 11/2016 | Hodel | |
| 2017/0217026 | A1 | 8/2017 | Sipe | |
| 2017/0356438 | A1 | 12/2017 | Hughes | |
| 2018/0106041 | A1 * | 4/2018 | Sorkin | E04C 5/012 |
| 2018/0335024 | A1 | 11/2018 | Hughes | |
| 2020/0173430 | A1 | 6/2020 | Hughes et al. | |

FOREIGN PATENT DOCUMENTS

| | | | | |
|---|---|---|---|---|
| FR | 2811002 | A1 * | 1/2002 | E04C 5/07 |
| GB | 998313 | A | 7/1965 | |
| JP | 3165419 | B1 * | 5/2001 | |
| WO | WO-2008118686 | A1 * | 10/2008 | E04G 21/121 |

OTHER PUBLICATIONS

Translation of FR 2811002 A1 (Year: 2002).*

SPX—Hydraulic Post-Tensioning Jacks, from "http://www.spxflow.com/en/assets/pdf/102920_OpInst.pdf" archived on Aug. 7, 2016, archived URL: "https://web.archive.org/web/20160807001428/http://www.spxflow.com/en/assets/pdf/102920_OpInst.pdf" (Year: 2016).*

Translation of JP 3165419 B1 (Year: 2001).*

International Search Report and Written Opinion dated Feb. 27, 2025 received in PCT/US2024/058949, 9 pages.

International Search Report and Written Opinion dated Feb. 14, 2025 received in related PCT/US2024/058666, 12 pages.

* cited by examiner

100

LIGHTWEIGHT DUAL ACTION POST-TENSIONING JACK WITH TWO HANDLE CHUCK

CROSS-REFERENCE TO RELATED APPLICATIONS

This application claims priority to U.S. Provisional Patent Application No. 63/557,808, entitled "Lightweight Dual Action Post-Tensioning Jack and Method for Using Same," filed on Feb. 26, 2024 and U.S. Provisional Patent Application No. 63/606,776, entitled "Post-Tensioning Jack with Two-Handle Chuck," filed Dec. 6, 2023. The entire disclosure of these priority applications are incorporated herein by reference in their entirety.

This application relates to U.S. patent application Ser. No. 18/501,311, entitled "Frameless Lightweight Post-Tensioning Jack and Method for Using Same," filed on Nov. 3, 2023, the entire disclosure of which is incorporated herein by reference in its entirety.

FIELD OF THE DISCLOSURE

The present disclosure relates to post-tensioning concrete, and more specifically to post-tensioning jacks and methods of use.

BACKGROUND INFORMATION

Pre-stressed concrete is structural concrete in which internal stresses are introduced to reduce potential tensile stresses in the concrete resulting from applied loads. Pre-stressing may be accomplished by post-tensioned pre-stressing or pre-tensioned prestressing. In post-tensioned pre-stressing, a tension member is tensioned after the concrete has attained a desired strength by use of a post-tensioning tendon. The post-tensioning tendon may include for example and without limitation, anchor assemblies, the tension member, and sheathes.

Traditionally, a tension member is constructed of a material that can be elongated and may be a single or a multi-strand cable. The tension member may be formed from a metal, such as reinforced steel. The post-tensioning tendon traditionally includes an anchor assembly at each end. The tension member is fixedly coupled to a fixed anchor assembly positioned at one end of the post-tensioning tendon, the "fixed end," and stressed at the stressed anchor assembly positioned at the opposite end of the post-tensioning tendon, the "stressing end" of the post-tensioning tendon.

In a typical tendon tensioning anchor assembly in post-tensioning operations, there are provided anchors for anchoring the ends of the cables suspended therebetween. In the course of installing the cable tensioning anchor assembly in a concrete structure, a hydraulic jack or the like is releasably attached to one of the exposed ends of cable (the stressing end) for applying a predetermined amount of tension to the tendon. When the desired amount of tension is applied to the cable, wedges, threaded nuts, or the like, are used to capture the cable and, as the jack is removed from the tendon, to prevent its relaxation and hold it in its stressed condition.

To releasably attach a post tensioning jack to an exposed end of a tensioning tendon or cable, the tendon must be placed within a center channel of the jack. When the jack is operated, two jack pistons extend, thereby separating two portions of the jack. In order to tension a tendon, the front nose portion of the jack must be braced against a fixed object such as the concrete, or in most instances, a wedge anchor that fits between the tendon and the concrete to be post-tensioned. The other end of the jack must engage with the tendon so that as the jack sections separate, the tendon is pulled and thereby tensioned. Conventional post-tensioning jacks include a tendon chuck that is designed to grab the tendon as the jack sections separate during operation of the jack. However, there can be slippage and inefficiencies in the operation of conventional chucks.

Current post-tensioning jacks (PTJ) are shown in FIG. 1. These are single acting (SA) PTJ models with spring seating or power seating are suitable for slab-on-grade and other applications. Double acting (DA) models typically have an 8.5" stroke and are machined from steel billets. They typically feature standard power seating and have gun-drilled hydraulic fluid passages. Nose lengths may vary and a full line of gripper sizes are usually available to stress most common strand sizes.

While these PTJ are typical and used throughout the industry, these PTJ can be heavy, which makes use awkward in certain situations. Moreover, these existing jacks present a pinch hazard when they return from a working position to a resting position.

These and other deficiencies exist.

SUMMARY

Exemplary embodiments include a post-tensioning jack having a frame, having a front and rear portion, with two hydraulic pistons mounted in the front portion, the two hydraulic pistons having a retracted position and a working position; a pressure cylinder mounted to an assembly on an end of the two hydraulic pistons, such that a gap is maintained between the pressure cylinder and the frame in the retracted position; and the pressure cylinder configured to receive a tendon to which tension is to be applied.

Another exemplary embodiment includes a post-tensioning jack having a frame, having a front and rear portion, with two hydraulic pistons mounted in the front portion, the two hydraulic pistons having a retracted position and a working position; a hydraulic connection to provide power to move the two hydraulic pistons and provide at least 7000 psi of pressure on a tendon to which tension is to be applied; a pressure cylinder mounted to an assembly on an end of the two hydraulic pistons, such that a gap is maintained between the pressure cylinder and the frame in the retracted position; and the pressure cylinder configured to receive the tendon.

Another exemplary embodiment includes a post-tensioning jack having a frame, having a front and rear portion, with two hydraulic pistons mounted in the front portion, the two hydraulic pistons having a retracted position and a working position; a pressure cylinder mounted to an assembly on an end of the two hydraulic pistons; the pressure cylinder configured to receive a tendon to which tension is to be applied; a dual handle assembly, having a first handle and a second handle; a first bracket attached to a front portion of the frame and a second bracket attached to a rear portion of the frame; and a metal rod extending between the first and second brackets and having a length, the metal rod extending through a center axis of each of the first handle and the second handle.

Another exemplary embodiment includes a post-tensioning jack having a frame, having a front and rear portion, with two hydraulic pistons mounted in the front portion, the two hydraulic pistons having a retracted position and a working position; a pressure cylinder mounted to an assembly on an end of the two hydraulic pistons; the pressure cylinder configured to receive a tendon to which tension is to be applied; a slidable handle; a first bracket attached to a front portion of the frame and a second bracket attached to a rear portion of the frame; a metal rod extending between the first and second brackets and having a length and running through a center axis of the slidable handle such that the slidable handle is slidable along a length of the metal rod from the second bracket towards the first bracket; and a chuck attached to the slidable handle and configured to frictionally engage with a tendon when the slidable handle is moved towards the first bracket such no or limited slippage occurs between the chuck and the tendon when tension is placed on the tendon by the post-tensioning jack.

BRIEF DESCRIPTION OF THE DRAWINGS

Various embodiments of the present disclosure, together with further objects and advantages, may best be understood by reference to the following description taken in conjunction with the accompanying drawings.

Figure 1:
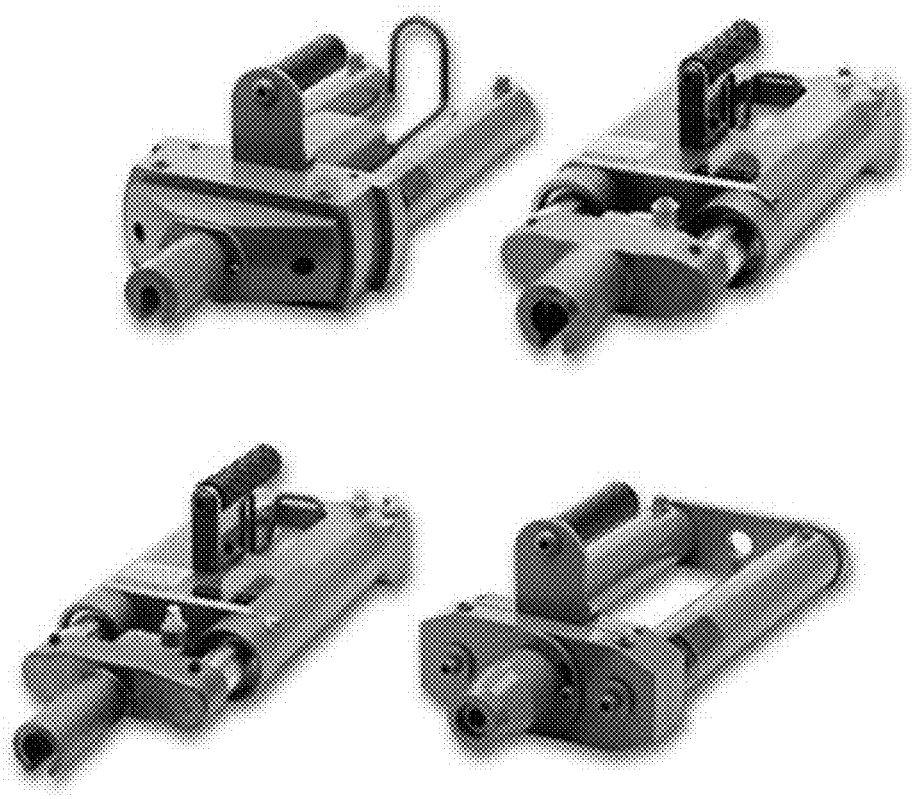
FIG. 1 (PRIOR ART)
FIG. 1 shows prior art post-tensioning jacks.

These and other objects, features and advantages of the exemplary embodiments of the present disclosure will become apparent upon reading the following detailed description of the exemplary embodiments of the present disclosure, when taken in conjunction with the appended paragraphs.

DETAILED DESCRIPTION

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Exemplary embodiments of the invention will now be described in order to illustrate various features of the invention. The embodiments described herein are not intended to be limiting as to the scope of the invention, but rather are intended to provide examples of the components, use, and operation of the invention.

It may be beneficial to provide a lightweight post-tensioning jack that also maintains a gap in a resting position to avoid potential pinch hazards and also it may be beneficial to provide a two-handle tendon chuck that is capable of providing enough friction between the chuck and tendon to avoid slippage and tensioning inefficiencies. Thus, exemplary embodiments improve upon the current jacks depicted in FIG. 1, for example.

Certain exemplary embodiments of the present disclosure are directed to a dual action (alternatively, dual-action or DA) lightweight jack (alternatively, post-tensioning jack or PTJ) for stressing a tension member. Exemplary embodiments re hydraulically powered, such as through hydraulic fluid delivered by a hydraulic pump having a hydraulic fluid source. A pressure gauge may be included to measure when a tendon has been sufficiently tensioned. The hydraulic pump powering the jack can be powered by generator, or simple and conventional corded electrical connection. In various embodiments, the dual action lightweight jack may be powered by a battery powered portable hydraulic pump, thereby eliminating the need for generator, fuels, functional power outlets, etc. The dual action lightweight jack may also include the tendon chuck features described herein.

In exemplary embodiments, the dual action lightweight jack may provide over 7000 to 8000 psi of pressure on a tendon, as compared with around 5000 psi on conventional designs. In some embodiments, the dual action lightweight jack may include a digital display that provides a real-time pressure reading as a tendon is tensioned. In other embodiments, the hydraulic pump may include a digital display that provides a real-time pressure reading as a tendon is tensioned. The dual action lightweight jack has a retracted/resting position and an extended/working position. Exemplary embodiments may be configured to maintain a gap between a pressure cylinder body/frame and an extending body sufficient to avoid potential pinching, cutting, etc. of fingers, skin, or any part of the body when in the retracted or resting position. For example, in some embodiments, the gap may be an inch or more.

Exemplary embodiments of the dual action lightweight jack may provide significant weight savings as compared to conventional jacks, such as those illustrated in FIG. 1. Exemplary embodiments may include multiple versions of the dual action lightweight jack based on its tensioning capacity. For example, a weight comparison between existing designs and embodiments show a weight savings of approximately 13 to 18 lbs, depending upon the model and application. The weight savings may be due to a number of innovations and/or improvements. For example, exemplary embodiments may include a unibody design that simplifies hydraulic routing and strengthens the pistons/cylinders, thereby leading to smaller diameter pistons/cylinders with thinner sidewalls.

Certain exemplary embodiments may also include a sliding two-handle chuck. The sliding two-handle chuck may be incorporated into dual action lightweight chuck described above. The dual handle may have a chuck attached to one slidable portion of the dual handle. The handle assembly may attach to a front and rear portion of the jack frame. The handle assembly may be attached with brackets. A metal rod may extend between the two brackets. The rod may be fixed between the two brackets, or may be capable of rotating axially along the length of the rod. The front portion of the rod, near the front bracket may include a fixed handle with any sort of material to help with gripping, lifting, moving, and/or operating the jack.

In some embodiments, the material used on the fixed handle of the handle assembly may be rubber or any other durable material that provides comfort and is resistant to the working environment. Behind the fixed handle there may be a rear handle slidably attached to the handle assembly rod. The rear handle may include a metal tube surrounding the handle assembly rod and a second grip of suitable material installed onto the metal tube. The slidable handle may include a metal plate between the two grips, which may be configured to fixably attach a chuck assembly. A chuck assembly may attach to the slidable handle with bolts, rivets, etc. The chuck assembly may include a metal plate designed to interface with the metal plate on the slidable handle, as well as two metal members extending therefrom to the primary chuck assembly that engages with a tensioning tendon.

The slidable handle is designed to be smaller than the length of the rod behind the fixed grip, thereby permitting sliding in an axial direction along the axis of the handle rod. Sliding the slidable handle axially changes the axial position of the chuck relative to the jack frame. When the jack is placed onto a tendon, the slidable handle may be in a position distal from the fixed handle. Then the slidable handle may be moved axially towards the fixed handle. This movement may cause the chuck to engage the tendon and provide friction so that the jack is grabbing the tendon. The amount of friction may be dictated by the design of the chuck (i.e., engagement pad materials, wedge geometry, etc.), as well as how hard the slidable handle is forced in a axial direction toward the fixed handle. Exemplary embodiments may be configured so that the resulting friction between the chuck and tendon is sufficient to avoid slipping when the jack is operated to pull the tendon.

Figure 2A:
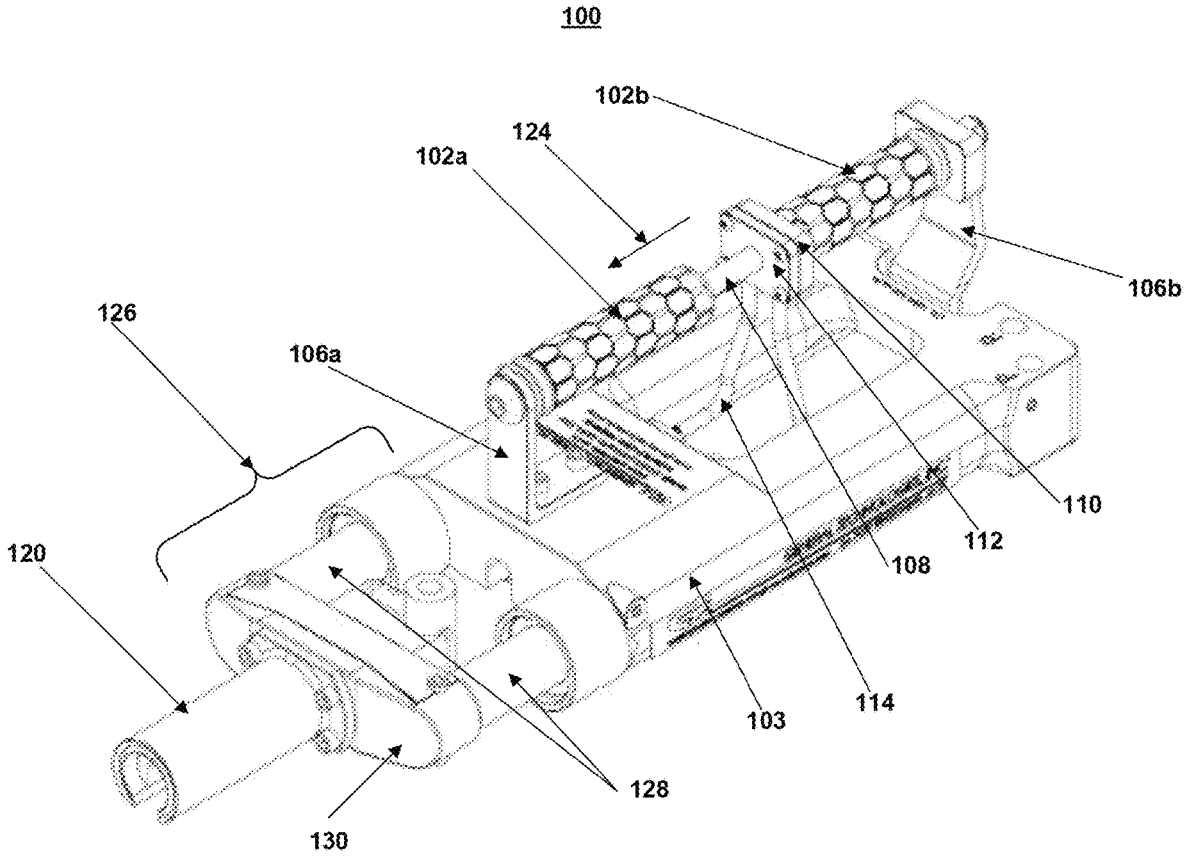
FIG. 2A is a top perspective view of a dual action lightweight post-tensioning jack according to exemplary embodiments.

FIGS. 2A, 2B, 3, 4, 5, 6A, 6B, 7, 8, and 9 depict dual action lightweight jack 100 in a (fully) retracted or resting position according to exemplary embodiments. Exemplary embodiments of the dual action lightweight jack may include a removable/replaceable nose piece, which may be referred to as a pressure cylinder 120. The pressure cylinder 120 is mounted to a mounting assembly 130 which is attached to two pistons 128, which are movaebly (slidabley) mounted into the frame 103 of the dual action lightweight jack 100. The pistons 128 are hydraulically operated. In FIG. 2A, for example, the retracted position is depicted.

Figure 3:
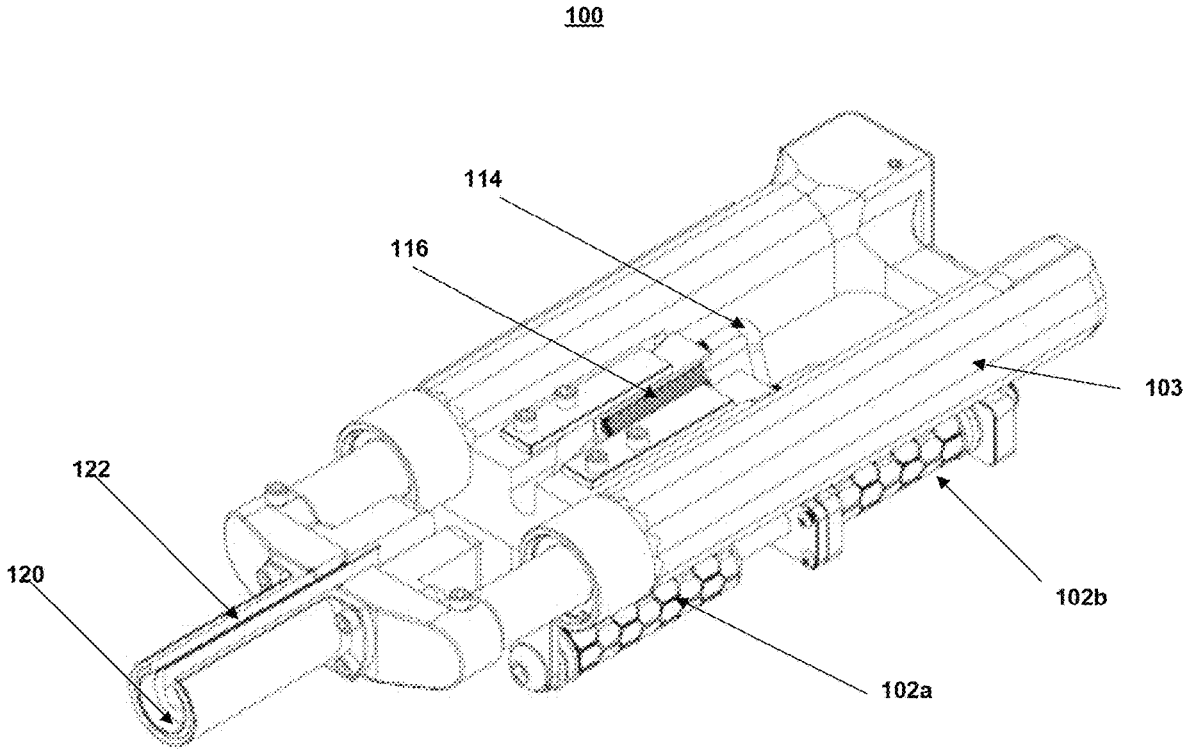
FIG. 3 is a bottom perspective view of the dual action lightweight post-tensioning jack according to exemplary embodiments.
Figure 4:
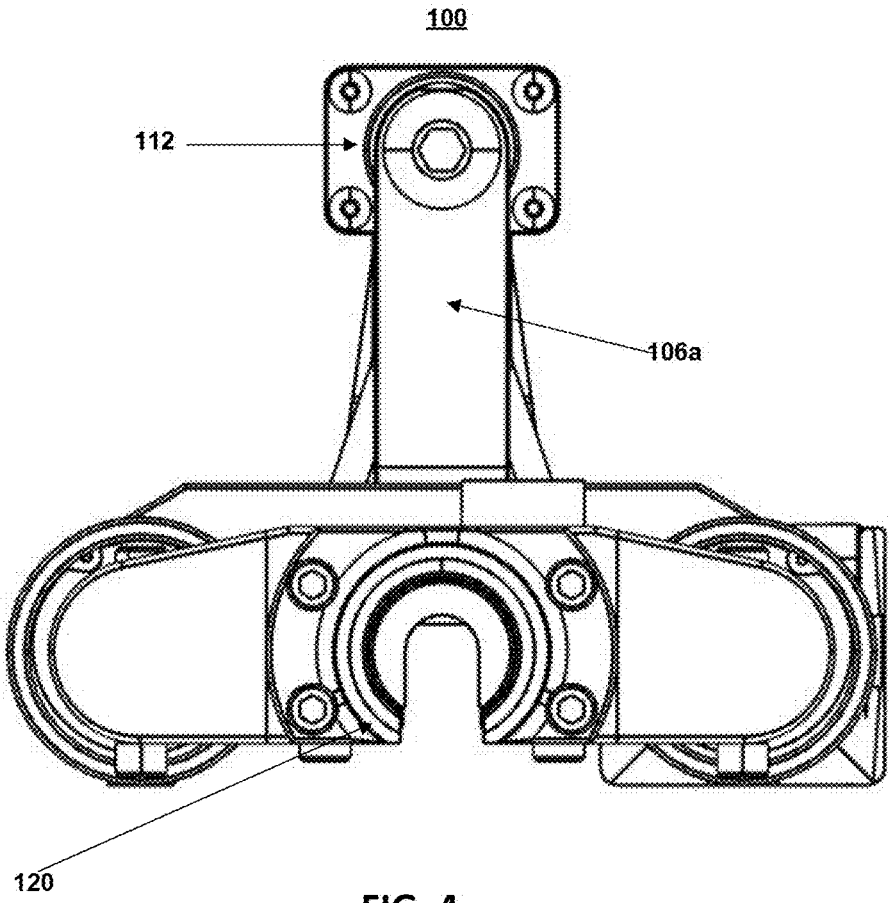
FIG. 4 is a front view of the dual action lightweight post-tensioning jack according to exemplary embodiments.
Figure 5:
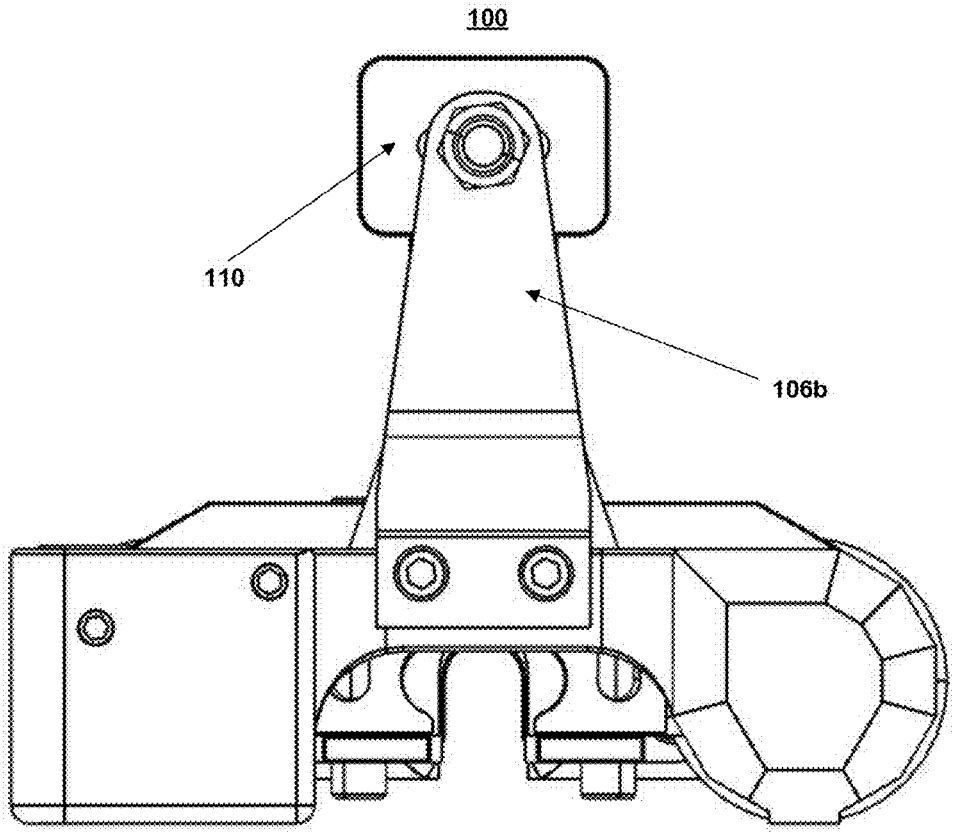
FIG. 5 is a rear view of the dual action lightweight post-tensioning jack according to exemplary embodiments.
Figure 6A:
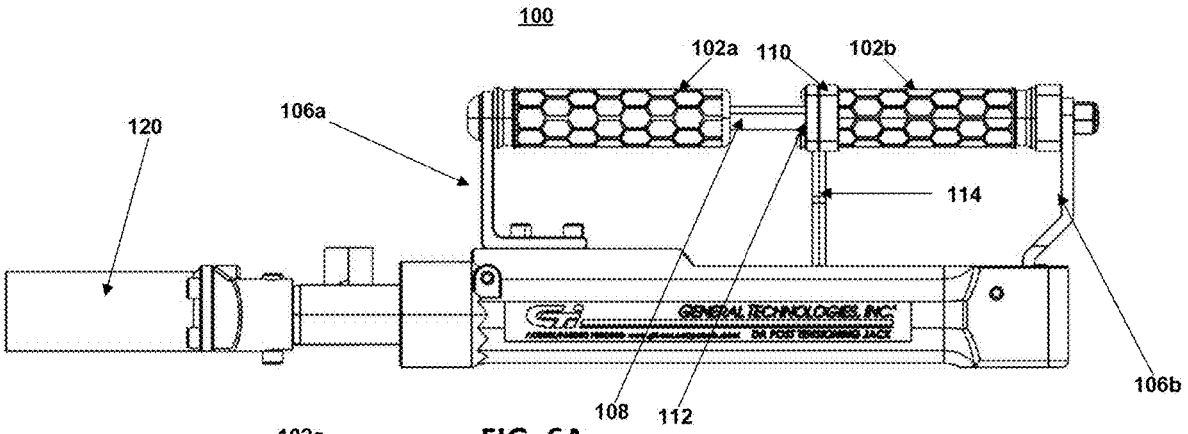
FIGS. 6A and 6B are side views of the dual action lightweight post-tensioning jack according to exemplary embodiments.
Figure 6B:
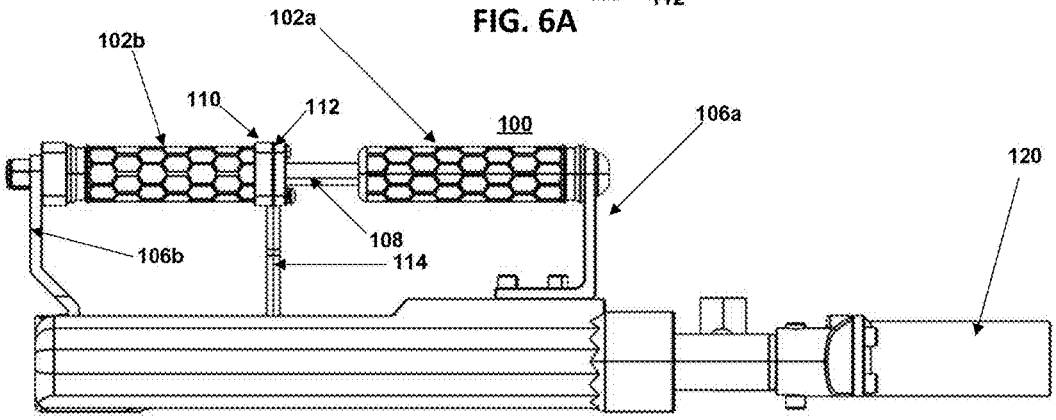
Figure 7:
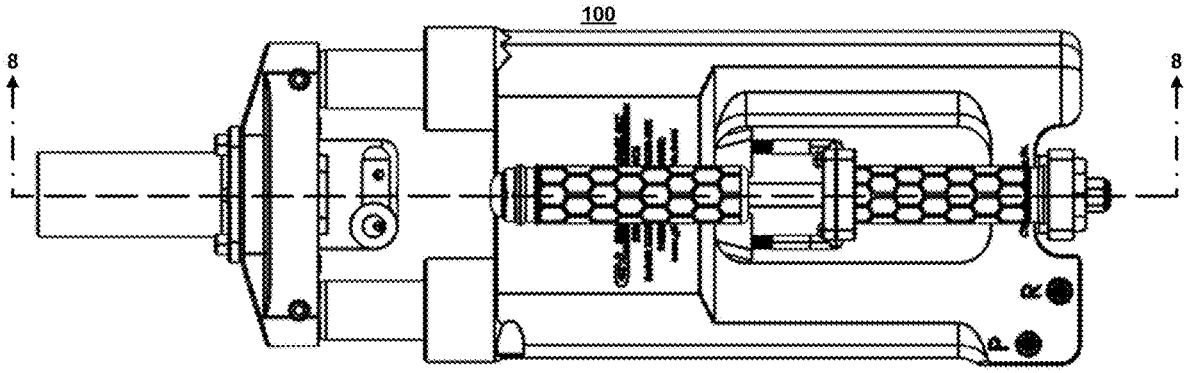
FIG. 7 is a top view of the dual action lightweight post-tensioning jack according to exemplary embodiments.

The pressure cylinder 120 may serve as a bearing surface during tensioning operation, and as such, may wear over time. Exemplary embodiments can allow for replacement of this wear part in order to extend the useful life of exemplary dual action lightweight jacks according to the present disclosure. The removable nose piece may also be modular and may allow for use with different size tensioning strands. Exemplary embodiments may include a nose piece with a tongue and groove design. As can be seen in FIG. 3, for example, the pressure cylinder 120 may have a cut-out 122 to accept a tendon. The gap 126 between the pressure cylinder 120 and the frame 103 can be seen, for example, in FIG. 2A.

The jack as shown in may include a dual handle assembly, consisting of front handle (or fixed handle) 102*a* and rear handle (or slidable handle) 102*b*, with a chuck assembly 104 attached to one slidable portion of the dual handle. The front handle 102*a* may also be referred to as the fixed handle. The rear handle 102*b* may also be referred to as the slidable handle.

The handle assembly attaches to a front and rear portion of the jack frame 103. The dual handle assembly is attached with brackets 106*a* and 106*b*. In other embodiments, other attachment mechanisms or hardware may be used. The front handle 102*a* is attached to or mounted to the front bracket 106*a*. That is, it is fixed. The front handle 102*a* may be secured to the front bracket with a nut or rivet or other suitable fastener. This may be a removable fastener. The rear handle 102*b* is not attached to the rear bracket 106*b* so that is can slidably move. A rod 108 extends between the two brackets. The rod 108 may be made of metal; in various other embodiments, other materials such as plastic may be used. The rod 108 may be fixed between the two brackets 106*a/b*, or can be capable of rotating axially along the length of the rod (that is, it may be rotationally mounted). The front portion of the rod 108, near the front bracket 106*a*, extends into the fixed handle of the handle assembly (that is, handle 102*a*) and is attached to the front bracket 106*a*. The front handle can include any material that helps with gripping, lifting, moving, and/or operating the jack 100. In some embodiments, the material used on the fixed handle 102*a* of the handle assembly may be rubber or any other durable material that provides comfort and is resistant to the working environment.

Behind the fixed handle, the second handle (that is, handle 102*b*) is slidably attached to the rod 108. That is, the rear end of the rod is attached to or mounted to the rear bracket 106*b*, but the rear handle 102*b* is not. The rear end of the rod may be secured to the bracket with a nut or rivet or other suitable fastener. This may be a removable fastener. The second handle may include a metal tube on its interior surrounding the handle assembly rod and a second grip of suitable material installed onto the metal tube (the material may be the same as the material on the front handle 102*a*). A metal plate 110 may be located at the front portion of the handle 102*b* that is configured to fixably attach a second metal plate 112 of chuck assembly 104. This serves to attach the chuck assembly to the slidable handle portion. The metal plates 110 and 112 may be secured with suitable hardware such as screws, bolts, rivets, etc. The metal plates may be removably secured to allow for removal and/or replacement of the chuck assembly. The chuck assembly 104 includes two metal members or a single bracket 114 extending downward from the metal rod 108 to the primary chuck 116 (or two-piece chuck) that engages with a tensioning tendon. As can be seen in the Figures, such as FIG. 9, the primary chuck 116 may have two pieces. The primary chuck 116 may have rough and/or grooved and/or threaded internal surface as can be seen to facilitate frictional gripping when in contact with a tendon.

Figure 2B:
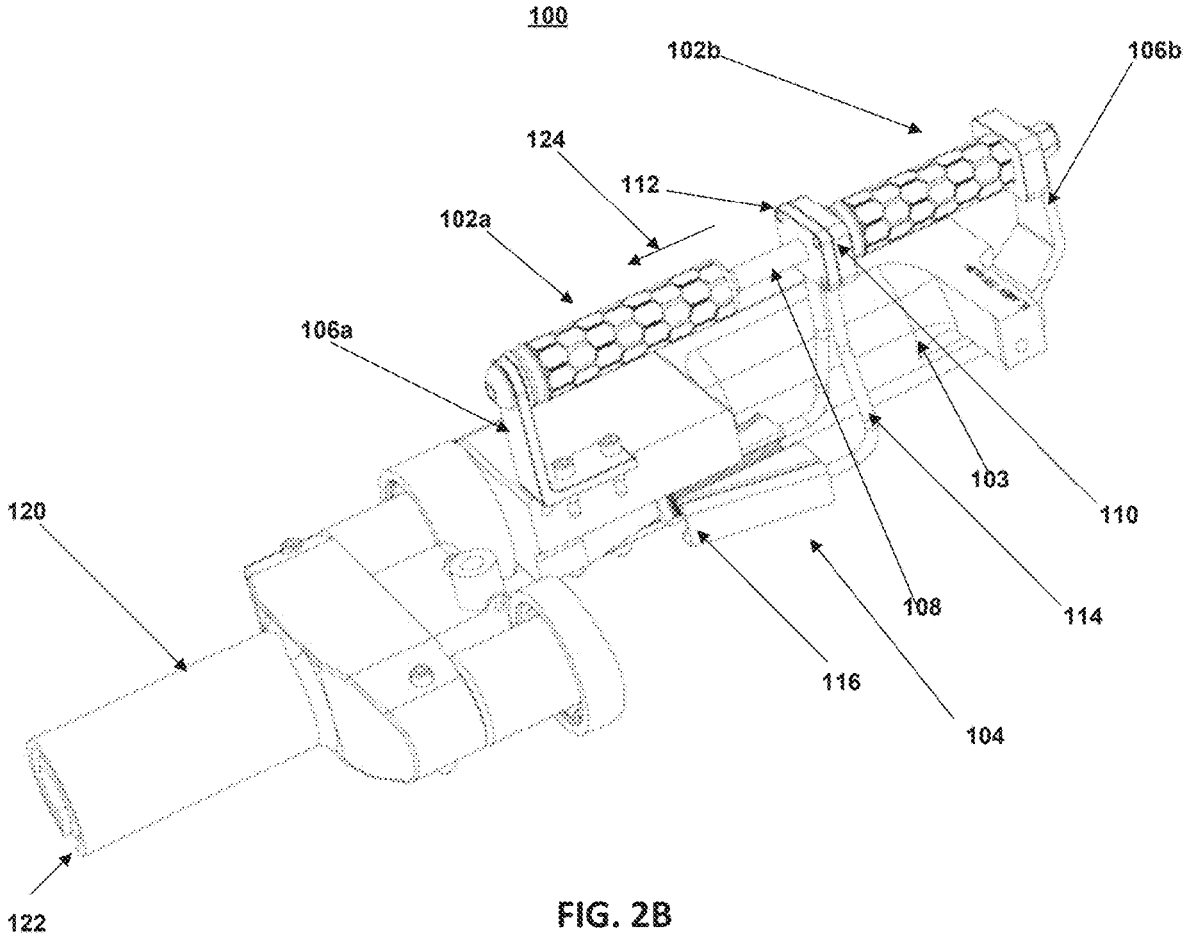
FIG. 2B is a cut-away top perspective view of the dual action lightweight post-tensioning jack according to exemplary embodiments.
Figure 8:
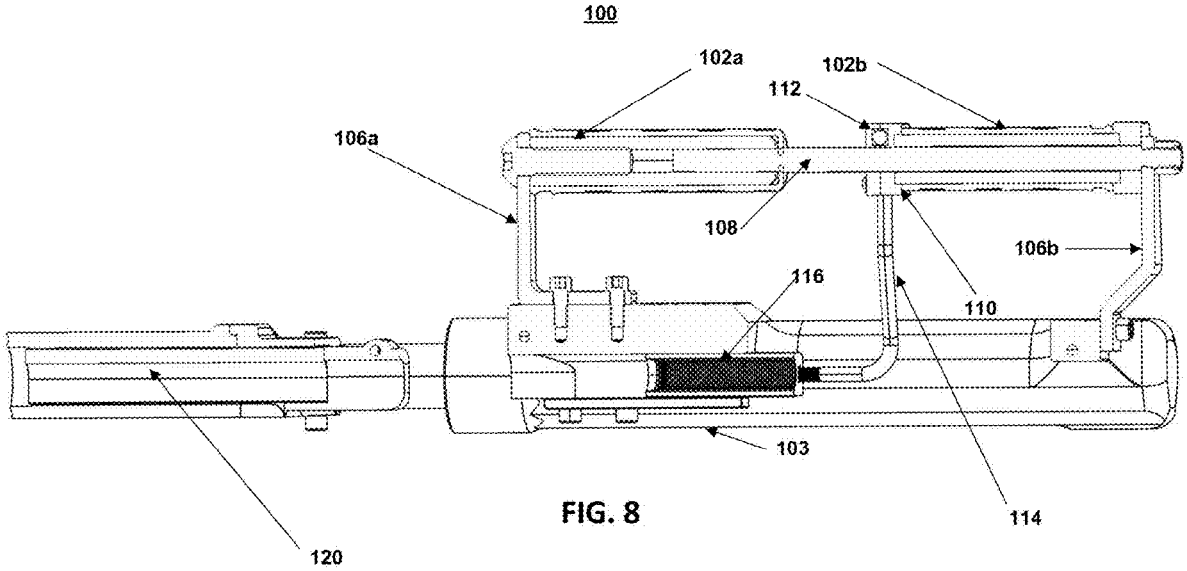
FIG. 8 is a sectional view along line 8-8 of the dual action lightweight post-tensioning jack according to exemplary embodiments.
Figure 9:
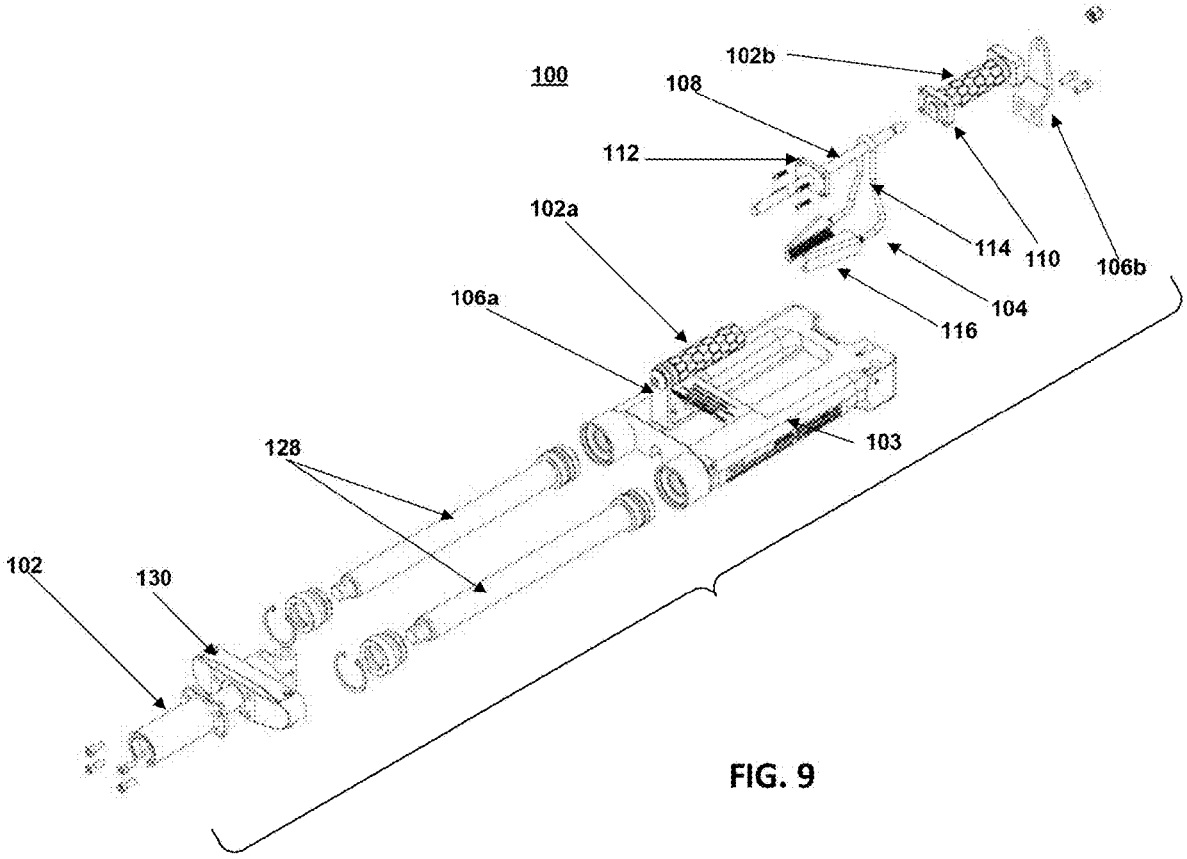
FIG. 9 is an exploded view of the dual action lightweight post-tensioning jack according to exemplary embodiments.

The slidable handle 102*b* is designed to be smaller than the length of the rod 108 behind the fixed grip, thereby permitting sliding in an axial direction 124 along the axis of the handle rod. Sliding the slidable handle axially changes the axial position of the chuck relative to the jack frame 103. When the jack is placed onto a tendon, the slidable handle may be in a position distal from the fixed handle (such as shown in FIGS. 2A and 2B, for example). Then the slidable handle may be moved axially towards the fixed handle in the direction 124. This movement may cause the primary chuck to engage the tendon and provide friction so that the jack is grabbing the tendon. The amount of friction may be dictated by the design of the chuck (i.e., engagement pad materials, wedge geometry, etc.), as well as how hard the slidable handle is forced in the axial direction toward the fixed handle. Exemplary embodiments may be configured so that the resulting friction between the chuck and tendon is sufficient to avoid slipping when the jack is operated to pull the tendon. As can be seen in FIG. 8, for example, the inside of the primary chuck 116 may be threaded or otherwise have a rough surface to facilitate gripping onto the tendon. The frame 103 may be moveably or slidably attached to the pressure cylinder 120 and its mounting assembly 130 by two pistons 128. These pistons allow the frame 103 to move rearward from the pressure cylinder 120 during tensioning operations on a tendon as the tendon is gripped by the primary chuck.

Figure 10:
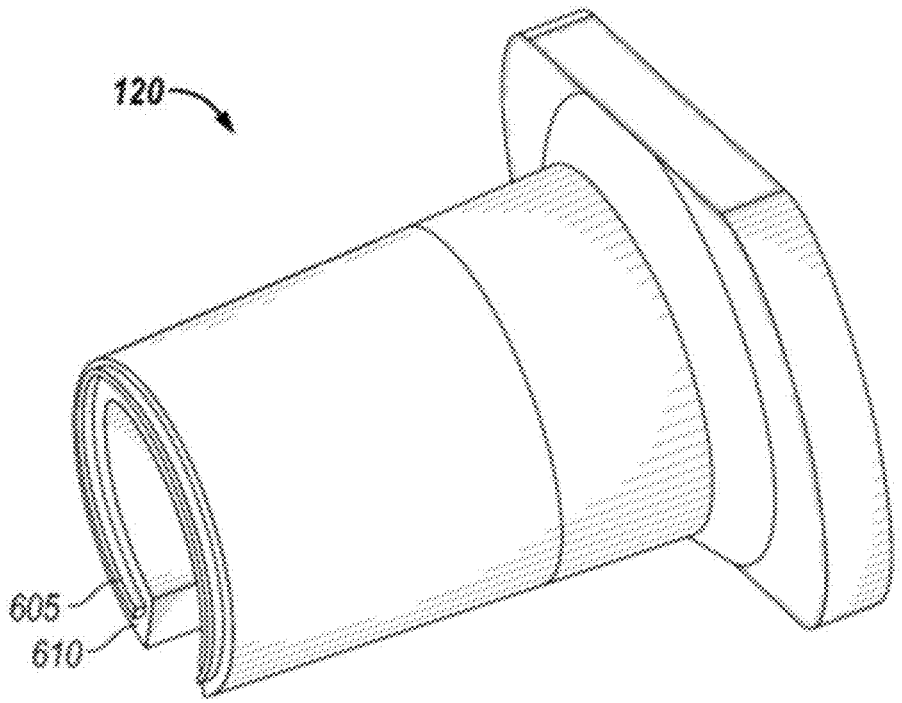
FIG. 10 depicts a pressure cylinder or nose piece of the dual action lightweight post-tensioning jack according to exemplary embodiments.

In FIG. 10, a pressure cylinder (nose piece) 120 with a tongue 605 is shown. Tongue 605 is located on surface 610 of pressure cylinder 120. Surface 610 may be circular with a section removed for installing and removing a tensioning tendon. Tongue 605 may be of a uniform thickness and diameter, and in some embodiments may be centered on surface 610. In some embodiments, tongue 605 may be continuous, in other embodiments, tongue may be broken into multiple arc sections.

Figure 11A:
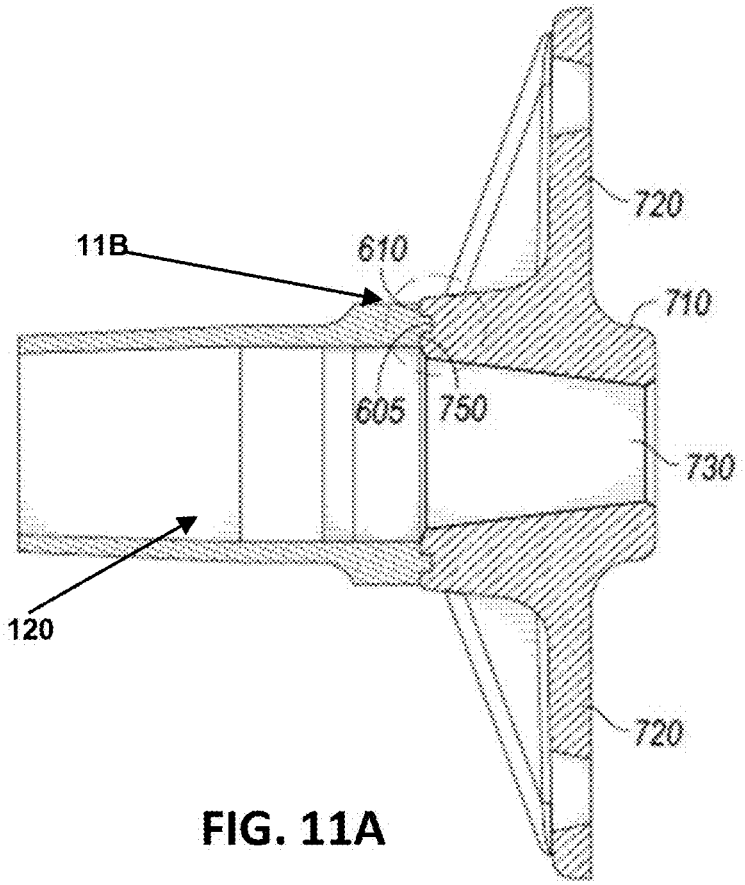
FIGS. 11A and 11B depict a section view and detail of an engagement between the pressure cylinder of the dual action lightweight post-tensioning jack and a post tensioning anchor according to exemplary embodiments.
Figure 11B:
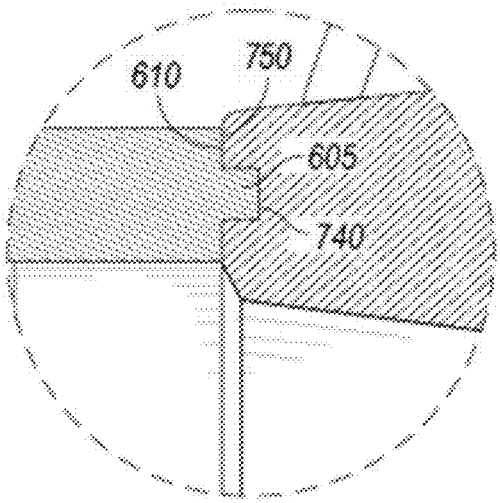

FIGS. 11A and 11B show an anchor 710 in engagement with the pressure cylinder 120 of FIG. 10. The anchor 710 may be configured to fit into a concrete structure to be post-tensioned. A tensioning tendon (not shown) is threaded through anchor 710, and then anchor 710 may be placed loosely into the concrete structure to be post-tensioned. Anchor 710 may be designed to hold tension in a tendon relative to the concrete. As a result, anchor 710 may be designed to brace against the concrete. For example, in some embodiments, anchor 710 includes one or more flanges 720 that interface with a surface of the concrete structure. In other embodiments, anchor 710 may be frustoconical to be received in a similarly shaped hole in the concrete structure. Other potential engagement/interface geometry is possible. Anchor 710 is designed to receive a wedge or wedges designed to grab a tensioned tendon and then wedge against an inside surface 730 of anchor 710 as the tendon attempts to unload the tension applied by lightweight jack 100. Anchor 710 includes a groove 740 in an anchor surface 750 that is facing away from the concrete structure. Anchor surface 750 is ring-shaped with the ring thickness defined by a first radius at the inner edge of the surface and a larger second radius at the outer edge of the surface. The ring thickness of anchor surface 750 is designed to overlap or coincide with the thickness of pressure cylinder surface 610. In some embodiments, anchor surface 750 may be thicker than pressure cylinder surface 610, but still designed so that pressure cylinder surface 610 may fully engage with anchor surface 750.

Anchor surface 750 may include a groove 740. Groove 740 may be circular and in some embodiments, may be continuous, thereby forming a full circle on anchor surface 750. The diameter and thickness of circular groove 740 may be identical to the diameter of tongue 605. Tongue 605 and groove 740 may be configured so that tongue 605 can be received into groove 740.

For example, when lightweight jack 100 is used, it is placed on a tensioning tendon and then braced against an anchor before the jack is operated. In operation, the jack attempts to separate, with one section gripping the tensioning tendon and moving away from the concrete (i.e., the primary chuck 116) structure while the other jack section is braced against the anchor (i.e., the pressure cylinder 120). Thus, the anchor is bearing the load of jack as it tensions the tensioning tendon. This means that alignment of surface 610 of pressure cylinder 120 with anchor surface 750 is critical. Misalignment can cause slippage of the jack, injury, equipment damage, tendon damage, etc. The inclusion of tongue 605 and groove 740 ensures proper alignment prior to operation of lightweight jack 100. The depth of groove 740 may be the same or greater than the height of tongue 605. In this way, the bearing surfaces remain pressure cylinder surface 610 and anchor surface 750, and are not transferred to the just the tongue and groove.

Although embodiments of the present invention have been described herein in the context of a particular implementation in a particular environment for a particular purpose, those skilled in the art will recognize that its usefulness is not limited thereto and that the embodiments of the present invention can be beneficially implemented in other related environments for similar purposes. The invention should therefore not be limited by the above described embodiments, method, and examples, but by all embodiments within the scope and spirit of the invention as claimed.

Further, it is to be understood that the terminology used herein is for the purpose of describing particular embodiments only and is not intended to be limiting. The terms "a" or "an" as used herein, are defined as one or more than one.

In the invention, various embodiments have been described with references to the accompanying drawings. It may, however, be evident that various modifications and changes may be made thereto, and additional embodiments may be implemented, without departing from the broader scope of the invention as set forth in the claims that follow. The invention and drawings are accordingly to be regarded in an illustrative rather than restrictive sense.

What is claimed is:

1. A post-tensioning jack, comprising:

a frame, having a front and a rear portion, with two hydraulic pistons mounted in the front portion, the two hydraulic pistons having a retracted position and a working position;

a pressure cylinder mounted to a mounting assembly, the mounting assembly being mounted on an end of the two hydraulic pistons, such that a gap is maintained between the mounting assembly and the frame in the retracted position, wherein a portion of the two hydraulic pistons is exposed beyond the front portion of the frame in the retracted position; and the pressure cylinder configured to receive a tendon to which tension is to be applied;

a dual handle assembly, comprising a first handle and a second handle;

a first bracket positioned and attached at the front portion of the frame and a second bracket positioned and attached at the rear portion of the frame; and a metal rod extending between the first and second brackets and having a length, the metal rod extending through each of the first handle and the second handle with the first handle being fixably attached to the first bracket and the second handle being configured to slide, with respect to the frame, along the length of the metal rod between the first handle and the second bracket.

2. The post-tensioning jack of claim 1, wherein the gap is at least one inch.

3. A post-tensioning jack, comprising:

a frame, having a front and a rear portion, with two hydraulic pistons mounted in the front portion, the two hydraulic pistons having a retracted position and a working position;

a hydraulic connection to provide power to move the two hydraulic pistons and provide at least 7000 psi of pressure on a tendon to which tension is to be applied;

a pressure cylinder mounted to a mounting assembly, the mounting assembly being mounted on an end of the two hydraulic pistons, such that a gap is maintained between the mounting assembly and the frame in the retracted position, wherein a portion of the two hydraulic pistons is exposed beyond the front portion of the frame in the retracted position; and the pressure cylinder configured to receive the tendon;

a dual handle assembly, comprising a first handle and a second handle;

a first bracket positioned and attached at the front portion of the frame and a second bracket positioned and attached at the rear portion of the frame; and a metal rod extending between the first and second brackets and having a length, the metal rod extending through each of the first handle and the second handle with the first handle being fixably attached to the first bracket and the second handle being configured to slide, with respect to the frame, along the length of the metal rod between the first handle and the second bracket.

4. The post-tensioning jack of claim 3, wherein the pressure cylinder is removable and replaceable.

5. The post-tensioning jack of claim 3, the pressure cylinder further comprising:

a circular surface having a section removed to receive the tendon; and a tongue located on the circular surface and configured to mate with a corresponding groove on a tendon anchor.

6. The post-tensioning jack of claim 3, wherein the gap is at least one inch.

7. A post-tensioning jack, comprising:

a frame, having a front and a rear portion, with two hydraulic pistons mounted in the front portion, the two hydraulic pistons having a retracted position and a working position;

a pressure cylinder mounted to an assembly on an end of the two hydraulic pistons;

the pressure cylinder configured to receive a tendon to which tension is to be applied;

a dual handle assembly, comprising a first handle and a second handle;

a first bracket positioned and attached at the front portion of the frame and a second bracket positioned and attached at the rear portion of the frame; and a metal rod extending between the first and second brackets and having a length, the metal rod extending through each of the first handle and the second handle;

wherein the first handle is fixably attached to the first bracket and the second handle is configured to be slidable, with respect to the frame, along the length of the metal rod between the first handle and the second bracket.

8. A post-tensioning jack, comprising:

a frame, having a front and a rear portion, with two hydraulic pistons mounted in the front portion, the two hydraulic pistons having a retracted position and a working position;

a pressure cylinder mounted to an assembly on an end of the two hydraulic pistons;

the pressure cylinder configured to receive a tendon to which tension is to be applied;

a slidable handle;

a first bracket positioned and attached at the front portion of the frame and a second bracket positioned and attached at the rear portion of the frame;

a metal rod extending between the first and second brackets and having a length and running through the slidable handle such that the slidable handle is configured to be slidable, with respect to the frame, along the length of the metal rod from the second bracket towards the first bracket; and a chuck attached to the slidable handle and configured to frictionally engage with a tendon when the slidable handle is moved towards the first bracket, the chuck configured to limit slippage that occurs between the chuck and the tendon when tension is placed on the tendon by the post-tensioning jack.

9. The post-tensioning jack of claim 8, wherein the slidable handle is part of a dual handle assembly comprising a fixed handle and the slidable handle.

10. The post-tensioning jack of claim 9, wherein the fixed handle is fixably attached to the first bracket.

11. The post-tensioning jack of claim 10, wherein the slidable handle is configured to slide along the length of the metal rod between the second bracket and the fixed handle.

12. The post-tensioning jack of claim 8, wherein a gap is maintained between the pressure cylinder and the frame in the retracted position.

13. The post-tensioning jack of claim 12, wherein the gap is at least one inch.

14. The post-tensioning jack of claim 8, wherein the slidable handle is smaller than the length of the metal rod.

15. The post-tensioning jack of claim 8, wherein the chuck comprises a two-piece assembly is mounted on a third bracket attached to the slidable handle.

* * * * *